US008639142B2

(12) United States Patent
Aoki

(10) Patent No.: US 8,639,142 B2
(45) Date of Patent: Jan. 28, 2014

(54) IMAGE FORMING APPARATUS

(75) Inventor: Shinji Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 177 days.

(21) Appl. No.: 13/357,049

(22) Filed: Jan. 24, 2012

(65) Prior Publication Data

US 2012/0224873 A1 Sep. 6, 2012

(30) Foreign Application Priority Data

Mar. 4, 2011 (JP) ..... 2011-047226

(51) Int. Cl.
*G03G 15/16* (2006.01)

(52) U.S. Cl.
USPC ..... 399/66; 399/121; 399/101; 399/297

(58) Field of Classification Search
USPC ..... 399/66, 121, 101, 154, 297
See application file for complete search history.

(56) References Cited

U.S. PATENT DOCUMENTS

| | | | |
|---|---|---|---|
| 8,045,875 | B2 | 10/2011 | Aoki et al. |
| 2009/0123168 | A1 | 5/2009 | Aoki et al. |
| 2010/0098446 | A1 | 4/2010 | Ishikawa et al. |
| 2010/0232820 | A1 | 9/2010 | Usami et al. |
| 2010/0284705 | A1 | 11/2010 | Aoki et al. |
| 2011/0058831 | A1 | 3/2011 | Usami et al. |
| 2011/0200348 | A1 | 8/2011 | Aoki |
| 2011/0255892 | A1 | 10/2011 | Aoki |
| 2012/0045231 | A1 | 2/2012 | Ogino et al. |
| 2012/0045237 | A1 | 2/2012 | Aoki et al. |
| 2012/0045259 | A1 | 2/2012 | Nakamura et al. |

FOREIGN PATENT DOCUMENTS

| | | | |
|---|---|---|---|
| JP | 2007121619 | A | 5/2007 |
| JP | 2010-191088 | A | 9/2010 |

*Primary Examiner* — Walter L Lindsay, Jr.
*Assistant Examiner* — Roy Y Yi
(74) *Attorney, Agent, or Firm* — Harness, Dickey & Pierce, P.L.C.

(57) ABSTRACT

In an image forming apparatus transferring a toner image on an intermediate transfer member onto a sheet in a transfer nip between a nip forming member and the transfer member, a resistance or environment detection device detects electrical resistance of the sheet or an environmental parameter correlated with the resistance, an output device outputs a transfer current, a storage device stores, as an algorithm for calculating a transfer current target value according to an image area ratio in the nip, algorithms corresponding to different resistances or environmental parameters, and a control device selects and uses, from the algorithms, an algorithm according to the detection result of the resistance or environment detection device as the algorithm for calculating the target value, and controls an output current value to equalize a current value based on the image area ratio in the nip with the target value based on the algorithm.

10 Claims, 8 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2011-047226, filed on Mar. 4, 2011 in the Japanese Patent Office, the entire disclosure of which is hereby incorporated by reference herein.

FIELD OF THE INVENTION

Examples of the present invention relate to an image forming apparatus, such as a copier, a facsimile machine, or a printer, configured to change, in accordance with the area ratio of a toner image, a transfer current applied between an intermediate transfer member and a nip forming member that comes into contact with the intermediate transfer member to form a transfer nip.

BACKGROUND OF THE INVENTION

In certain image forming apparatuses, a constant current control is performed to maintain a transfer current flowing through a transfer nip at a predetermined value. In this type of image forming apparatus, the use of a coarse sheet with relatively large surface irregularities as a recording media tends to result in images with an uneven image density, making the image density lower in regions corresponding to recesses in a surface of a recording sheet than in regions corresponding to projections on the surface of the recording sheet.

To minimize unevenness in image density, the control target value for the transfer current can be increased in accordance with an increase in an image area ratio of a toner image entering the transfer nip. The transfer current is thus controlled for the following reason. That is, if left uncontrolled, a relatively large transfer current flows to the toner image on the intermediate transfer member in the transfer nip, discharge occurs in an air gap between a recess in the surface of the recording sheet and a portion of the toner image facing the recess, and toner in the portion of the toner image is oppositely charged. As a result, most of the toner in that portion of the toner image fails to be electrostatically transferred to the recess in the surface of the recording sheet, and thus the above-described unevenness in image density becomes prominent. In the transfer nip, therefore, it is desired not to apply an excessive amount of transfer current to the toner image.

With constant current control of the transfer current, however, a change in the image area ratio of the toner image entering the transfer nip results in a substantial change in the amount of current flowing into the toner image. Specifically, under a condition of controlling to maintain a constant output value of the transfer current from a power supply, the lower the image area ratio of the toner image entering the transfer nip, the larger the transfer current flowing into the toner image. As a result, the above-described discharge tends to occur. Conversely, the higher the image area ratio, the smaller the transfer current flowing into the toner image. As a result, a deficiency in image density tends to occur in the recesses in the surface of the recording sheet. To counteract this effect, as described above a larger transfer current is deliberately output in accordance with the increase in the image area ratio, to thereby apply an appropriate transfer current to the toner image regardless of the image area ratio.

In addition, the size of the transfer current flowing to the toner image in the transfer nip is affected by the electrical resistance of the recording sheet as well as by the image area ratio. Specifically, in the use of a recording sheet substantially reduced in electrical resistance owing to moisture absorption in a relatively highly humid environment, the transfer current more easily flows into an area of direct contact between a non-image area on the intermediate transfer member (i.e., an area in which no image is present) and the recording sheet than in the use of a recording sheet which has not absorbed a relatively large amount of moisture. As a result, the transfer current flowing to the toner image is reduced.

Accordingly, the recording sheet having absorbed a relatively large amount of moisture in a relatively highly humid environment may be subjected to a preliminary sheet feeding operation that is designed to remove moisture from the recording sheet, thereby enabling an appropriate transfer current to be applied to the toner image entering the transfer nip regardless of the initial moisture absorption state of the recording sheet. As a result, unevenness in image density is minimized.

In the above-described configuration, however, the preliminary sheet feeding operation is performed in addition to the actual printing operation. Therefore, the print time is extended. Further, if a preliminary heating device specifically for preliminary heating of the recording sheet is provided on a sheet feed path extending from a sheet feeding cassette to the transfer nip so as to prevent the extension of the print time, the initial cost and running costs of the image forming apparatus are increased.

SUMMARY OF THE INVENTION

The present invention describes a novel image forming apparatus. In one example, a novel image forming apparatus includes an image carrying member, an intermediate transfer member, a nip forming member, a transfer current output device, a detection device, a storage device, and a transfer current control device. The image carrying member is configured to carry a toner image. The intermediate transfer member is configured to carry, on a moving surface thereof, the toner image transferred from the image carrying member. The nip forming member is configured to come into contact with the intermediate transfer member to form a transfer nip, in which a surface of the nip forming member moves in the same direction as the moving direction of the intermediate transfer member and the toner image on the intermediate transfer member is transferred onto a surface of a recording sheet conveyed to the transfer nip. The transfer current output device is configured to output a transfer current to be applied between the intermediate transfer member and the nip forming member. The detection device includes one of a resistance detection device configured to detect the electrical resistance of the recording sheet and an environment detection device configured to detect an environmental parameter correlated with the electrical resistance. The storage device is configured to store, as an algorithm for calculating a target value of the transfer current according to a toner image area ratio in the transfer nip, a plurality of algorithms corresponding to different values of one of the electrical resistance and the environmental parameter. The transfer current control device is configured to perform a process of selecting, from the plurality of algorithms, an algorithm according to the result of detection by one of the resistance detection device and the environment detection device, and using the selected algorithm to calculate the target value, and configured to control an output value from the transfer current output device to equalize a transfer current value based on the toner image area ratio in the transfer nip with the target value calculated by the use of the algorithm.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
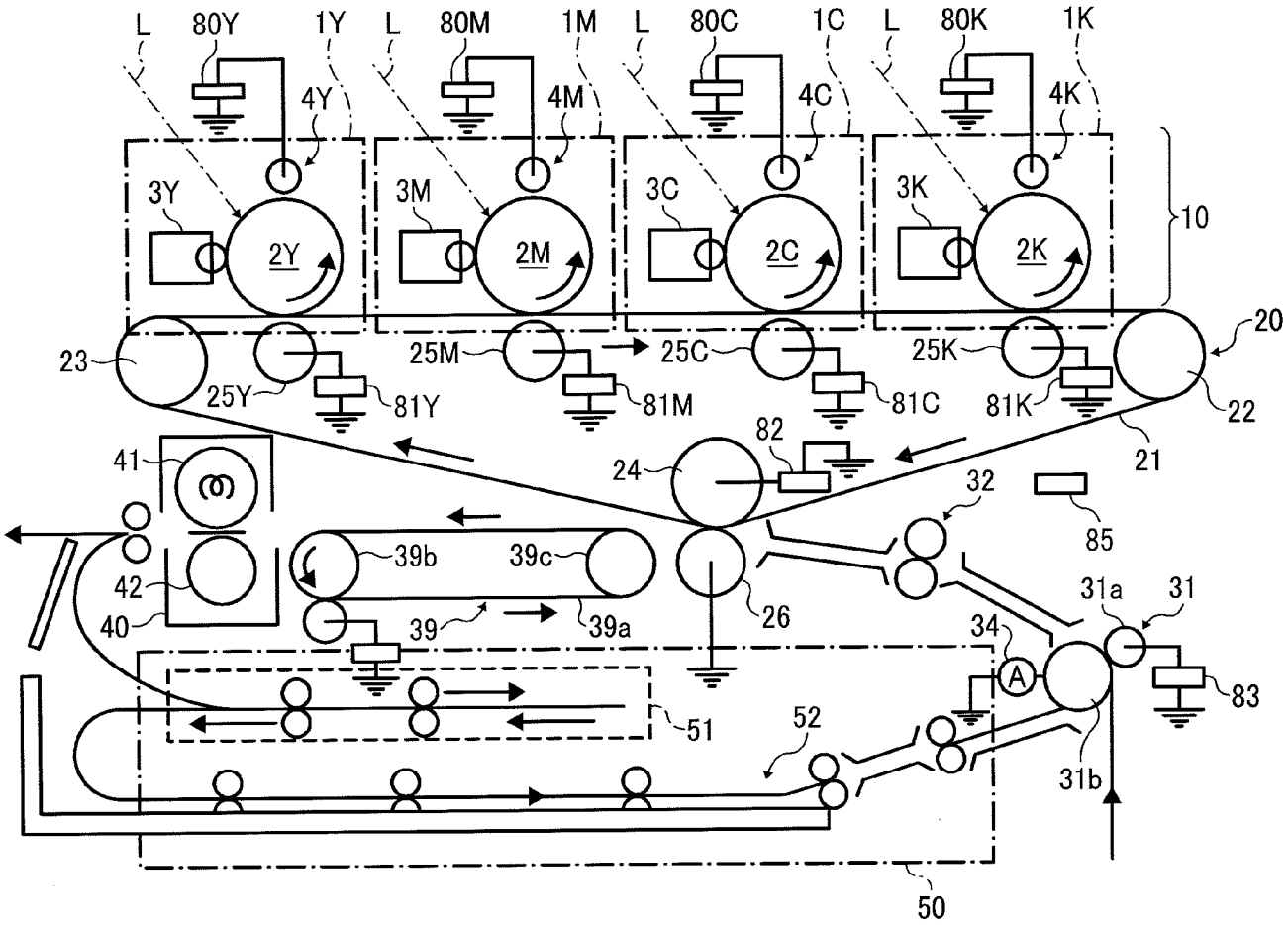
FIG. 1 is a schematic configuration diagram illustrating a printer according to an embodiment.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, embodiments of the present invention will be described.

A color printer (hereinafter simply referred to as printer) which forms a color image by using a tandem-type image forming unit will be described as an image forming apparatus according to an embodiment of the present invention.

A basic configuration of the printer according to the embodiment will be first described. FIG. 1 is a schematic configuration diagram illustrating the printer according to the embodiment. The printer includes a not-illustrated optical writing unit 30 (see FIG. 9), a tandem image forming unit 10, a transfer unit 20, a sheet conveying unit 39, a fixing device 40, a refeeding device 50, and so forth. The tandem image forming unit 10 includes four image forming units 1Y, 1M, 1C, and 1K for forming toner images of yellow, magenta, cyan, and black (hereinafter referred to as Y, M, C, and K, respectively) colors. The image forming units 1Y, 1M, 1C, and 1K use, as image forming material for forming images, Y, M, C, and K toners, respectively, which are different in color. Except for the difference in color, the image forming units 1Y, 1M, 1C, and 1K are similar in configuration.

The transfer unit 20 includes an endless intermediate transfer belt 21, a drive roller 22, a driven roller 23, a secondary transfer opposite roller 24, four primary transfer rollers 25Y, 25M, 25C, and 25K, and so forth. The endless intermediate transfer belt 21 serving as an image carrying member is wound around the drive roller 22, the driven roller 23, and the secondary transfer opposite roller 24 in a substantially inverted triangular form as viewed from a lateral side. In accordance with the rotational drive of the drive roller 22, the intermediate transfer belt 21 is rotated in the clockwise direction in the drawing. As well as the drive roller 22, the driven roller 23, and the secondary transfer opposite roller 24, the four primary transfer rollers 25Y, 25M, 25C, and 25K are disposed inside the loop of the intermediate transfer belt 21. The function of the primary transfer rollers 25Y, 25M, 25C, and 25K will be described later.

The tandem image forming unit 10 is disposed above the transfer unit 20 with the four image forming units 1Y, 1M, 1C, and 1K arranged in the horizontal direction along the upper stretched surface of the intermediate transfer belt 21. The image forming units 1Y, 1M, 1C, and 1K include drum-like photoconductors 2Y, 2M, 2C, and 2K, which are driven to rotate in the counterclockwise direction in the drawing, development devices 3Y, 3M, 3C, and 3K, and charging devices 4Y, 4M, 4C, and 4K, respectively. The image forming units 1Y, 1M, 1C, and 1K further include respective not-illustrated photoconductor cleaning devices for the Y, M, C, and K colors.

The charging devices 4Y, 4M, 4C, and 4K include respective charging rollers disposed to be in contact with or proximity to the photoconductors 2Y, 2M, 2C, and 2K. The charging rollers are driven to rotate by respective not-illustrated drive devices. The charging rollers for the Y, M, C, and K colors are applied with a predetermined charging bias by charging power supplies 80Y, 80M, 80C, and 80K, respectively. Thereby, discharge is caused between the charging rollers for the Y, M, C, and K colors and the photoconductors 2Y, 2M, 2C, and 2K, and the respective outer circumferential surfaces of the photoconductors 2Y, 2M, 2C, and 2K are uniformly charged to approximately −500 V. The above-described charging devices 4Y, 4M, 4C, and 4K may be replaced by scorotron chargers, for example.

The surfaces of the photoconductors 2Y, 2M, 2C, and 2K uniformly charged by the charging devices 4Y, 4M, 4C, and 4K are subjected to exposure scanning with laser light L emitted from the optical writing unit 30, and carry electrostatic latent images for the Y, M, C, and K colors. In the present printer, the electrostatic latent images are formed by the irradiation of the laser light L with the potential of the photoconductors 2Y, 2M, 2C, and 2K attenuated to approximately −30 V.

Each of the photoconductors 2Y, 2M, 2C, and 2K is formed by a drum having a diameter of approximately 30 mm, with an outer circumferential surface of the drum covered by an organic photosensitive layer, and has a capacitance adjusted to approximately 9.5E-7 F/$m^2$ (farads per square meter). The photoconductors 2Y, 2M, 2C, and 2K are driven to rotate in the counterclockwise direction in the drawing by respective not-illustrated drive devices, and come into contact with the upper stretched surface of the intermediate transfer belt 21 to form primary transfer nips for the Y, M, C, and K colors.

Each of the development devices 3Y, 3M, 3C, and 3K stores a not-illustrated developer containing the Y, M, C, or K toner and magnetic carrier, and has a casing formed with an opening through which a part of the outer circumferential surface of a cylindrical development sleeve is exposed to face the surface of the photoconductor 2Y, 2M, 2C, or 2K. With magnetic force generated by a not-illustrated magnet roller fixed inside the development sleeve so as not to rotate together with the development sleeve, the development sleeve carries the developer in the casing. Further, the development sleeve is driven to rotate and convey the developer to a development area in which the development sleeve faces the photoconductor 2Y, 2M, 2C, or 2K. In the development area, a development potential for moving the Y, M, C, or K toner of negative polarity from the development sleeve side toward the photoconductor side acts between a development bias applied to the development sleeve by a development power supply 84Y, 84M, 84C, or 84K (see FIG. 9) and the electrostatic latent image on the photoconductor 2Y, 2M, 2C, or 2K. Further, a non-image potential for moving the Y, M, C, or K toner of negative polarity from the photoconductor side toward the development sleeve side acts between the development sleeve and a non-image area on the photoconductor 2Y, 2M, 2C, or 2K. In the development area, the Y, M, C, or K toner in the developer is transferred to the electrostatic latent image on the photoconductor 2Y, 2M, 2C, or 2K by the action of the above-described development potential. Thereby, the electrostatic latent images on the photoconductors 2Y, 2M, 2C, and 2K are developed into Y, M, C, and K toner images.

Further, each of the development devices 3Y, 3M, 3C, and 3K includes a not-illustrated toner concentration sensor which measures the toner concentration in the developer stored therein. The result of detection by the toner concentration sensor is transmitted in the form of a voltage signal to a control unit 200 (see FIG. 9). The control unit 200 includes a RAM (Random Access Memory) 200*c*, which stores the respective target values of the output voltages from the toner concentration sensors for the Y, M, C, and K colors. Further, the control unit 200 compares the values of the output voltages from the toner concentration sensors for the Y, M, C, and K colors with the corresponding target values, and drives each of not-illustrated toner replenishing devices for the Y, M, C, and K colors for a time period according to the result of comparison. With this drive, the developer reduced in Y, M, C, or K toner concentration by the consumption of the Y, M, C, or K toner in the development process is replenished with an appropriate amount of the Y, M, C, or K toner. In the development devices 3Y, 3M, 3C, and 3K, therefore, the toner concentration in the developer is maintained in a predetermined range. The toner adhesion amount per unit area on the photoconductor 2Y, 2M, 2C, or 2K is approximately 0.45 mg/$cm^2$, when a full-page solid image is formed on the photoconductor 2Y, 2M, 2C, or 2K.

The transfer unit 20 is disposed below the image forming units 1Y, 1M, 1C, and 1K. In the transfer unit 20, the endless intermediate transfer belt 21 is rotated in the clockwise direction in the drawing, with the upper stretched surface thereof brought into contact with the photoconductors 2Y, 2M, 2C, and 2K to form the primary transfer nips for the Y, M, C, and K colors. As well as the intermediate transfer belt 21, the transfer unit 20 includes the primary transfer rollers 25Y, 25M, 25C, and 25K, the drive roller 22, the driven roller 23 serving as a tension roller, and the secondary transfer opposite roller 24, which are disposed inside the loop of the intermediate transfer belt 21. The transfer unit 20 further includes a secondary transfer roller 26 and a not-illustrated belt cleaning device, which are disposed outside the loop of the intermediate transfer belt 21.

The intermediate transfer belt 21 is an endless belt having a thickness of approximately 80 μm and including a belt base body made of a carbon-dispersed conductive polyimide resin, and has a modulus of elongation of approximately 3.5 GPa (giga Pascals). The intermediate transfer belt 21 further has a volume resistivity of approximately 3E11 Ω·cm (ohm centimeters) in an environment with a temperature of approximately 25° C. and a humidity of approximately 40% (hereinafter referred to as laboratory environment), and a volume resistivity of approximately 2E9 Ω·cm in an environment with a temperature of approximately 27° C. and a humidity of approximately 80% (hereinafter referred to as HH environment). The above volume resistivity values were both measured by a resistivity meter Hiresta-UP MCP-HT450 manufactured by Mitsubishi Chemical Analytech Co., Ltd. with an applied voltage of approximately 100 V. In accordance with the rotational drive of the drive roller 22, the intermediate transfer belt 21 wound with tension around the above-described rollers disposed inside the loop thereof is rotated in the clockwise direction in the drawing.

Under the primary transfer nips for the Y, M, C, and K colors, the primary transfer rollers 25Y, 25M, 25C, and 25K in the loop of the intermediate transfer belt 21 press the intermediate transfer belt 21 against the photoconductors 2Y, 2M, 2C, and 2K, respectively. Each of the primary transfer rollers 25Y, 25M, 25C, and 25K includes a metal rotary shaft member having an outer circumferential surface provided with a conductive sponge roller member made of a resin dispersed with an ion conductive agent. The conductive sponge roller member has a volume resistivity of approximately 4E8 Ω·cm in the laboratory environment and a volume resistivity of approximately 1E8 Ω·cm in the HH environment. The metal rotary shaft member is disposed at a position shifted downstream in the belt moving direction by approximately 3 mm from the rotary shaft of the photoconductor 2Y, 2M, 2C, or 2K.

The primary transfer rollers 25Y, 25M, 25C, and 25K are applied with a primary transfer bias having a polarity opposite to a toner charging polarity by primary transfer power supplies 81Y, 81M, 81C, and 81K, respectively. Thereby, transfer electric fields for attracting the toner images on the photoconductors 2Y, 2M, 2C, and 2K from the photoconductor side toward the belt side are formed in the primary transfer nips. While the intermediate transfer belt 21 sequentially passes the primary transfer nips for the Y, M, C, and K colors in accordance with the circular movement thereof, the Y, M, C, and K toner images on the photoconductors 2Y, 2M, 2C, and 2K are primary-transferred in a superimposed manner onto the outer circumferential surface of the intermediate transfer belt 21. Thereby, a four-color superimposed toner image is formed on the intermediate transfer belt 21.

Post-transfer residual toners adhering to the surfaces of the photoconductors 2Y, 2M, 2C, and 2K having passed the respective primary transfer nips for the Y, M, C, and K colors are removed from the surfaces of the photoconductors 2Y, 2M, 2C, and 2K by the respective not-illustrated photoconductor cleaning devices included in the image forming units 1Y, 1M, 1C, and 1K.

The secondary transfer roller 26, which is disposed outside the loop of the intermediate transfer belt 21, comes into contact with a portion of the intermediate transfer belt 21 extending in the circumferential direction wound around the secondary transfer opposite roller 24, to thereby form a secondary transfer nip. The secondary transfer opposite roller 24 has a diameter of approximately 16 mm and a volume resistivity of approximately 1E4 Ω·cm, and is applied with a secondary transfer bias by a secondary transfer power supply 82. Meanwhile, the secondary transfer roller 26 has a diameter of approximately 24 mm, and includes a core bar having a diameter of approximately 12 mm and covered by a sponge layer having a volume resistivity of approximately 5E8 Ω·cm in the laboratory environment and a volume resistivity of approximately 2E8 Ω·cm in the HH environment. The secondary transfer roller 26 is grounded by a ground wire.

The present printer further includes a not-illustrated sheet feeding cassette which stores a recording sheet bundle of a plurality of stacked recording sheets serving as recording media. The uppermost recording sheet of the recording sheet bundle is in contact with a not-illustrated sheet feeding roller. In accordance with the rotational drive of the sheet feeding roller by a not-illustrated drive device, the uppermost recording sheet in the sheet feeding cassette is fed to a sheet feed path.

An end of the sheet feed path is provided with a registration roller pair 32. The registration roller pair 32 nips the recording sheet between the two rollers thereof. Immediately thereafter, the rotation of the rollers is temporarily stopped. Then, the rollers are again rotated and convey the recording sheet toward the secondary transfer nip at an appropriate time for causing the recording sheet to synchronize with the four-color superimposed toner image on the intermediate transfer belt 21. In the secondary transfer nip, the toner images included in the four-color superimposed toner image on the intermediate transfer belt 21 are secondary-transferred onto the recording sheet at the same time by the action of the secondary transfer bias and nip pressure, and are formed into a full-color toner image with white color of the recording sheet.

The intermediate transfer belt 21 having passed the secondary transfer nip has post-transfer residual toner adhering thereto, having failed to be transferred to the recording sheet. The post-transfer residual toner is cleaned off by the not-illustrated belt cleaning device. The belt cleaning device is brought into contact with the outer circumferential surface of the intermediate transfer belt 21, and removes the post-transfer residual toner on the intermediate transfer belt 21 by electrostatically transferring the residual toner to a cleaning roller included therein.

The sheet conveying unit 39 is disposed near the exit of the secondary transfer nip. In the sheet conveying unit 39, an endless sheet conveying belt 39*a* is stretched by a drive roller 39*b* and a driven roller 39*c* into a horizontally long form extending in the horizontal direction, and is rotated in the counterclockwise direction in the drawing in accordance with the rotational drive of the drive roller 39*b*. The recording sheet having the four-color superimposed toner image secondary-transferred thereto at the secondary transfer nip passes the secondary transfer nip, and is attracted to the outer circumferential surface of sheet conveying belt 39*a* and conveyed in the right-to-left direction in the drawing in accordance with the movement of sheet conveying belt 39*a*. Then, the recording sheet reaches the area in which the sheet conveying belt 39*a* is wound around the drive roller 39*b*, and is separated from the sheet conveying belt 39*a*, not following the sheet conveying belt 39*a* moving along the circumferential surface thereof. The recording sheet is then conveyed to the fixing device 40.

In the fixing device 40, the recording sheet is nipped in a fixing nip formed by the contact between a heat fixing roller 41 and a pressure roller 42. The heat fixing roller 41 includes a heat generation source, such as a halogen lamp. The pressure roller 42 is pressed against the heat fixing roller 41. Then, a toner image fixing process based on a pressure and heat applying process is performed in the fixing nip. The recording sheet having the toner image thus fixed thereon is then discharged outside the printer via a not-illustrated sheet discharging roller pair.

The recording sheet discharged from the fixing device 40 may be directly conveyed to the sheet discharging roller pair, or may be conveyed not to the sheet discharging roller pair but to the refeeding device 50. Specifically, if a print job is performed in a simplex mode for forming an image only on a first surface of the recording sheet, the recording sheet discharged from the fixing device 40 is always conveyed to the sheet discharging roller pair. Meanwhile, if a print job is performed in a duplex mode for forming an image on both surfaces, i.e., the first and second surfaces of the recording sheet, and if the recording sheet discharged from the fixing device 40 carries a toner image only on the first surface thereof, the recording sheet is conveyed not to the sheet discharging roller pair but to the refeeding device 50. If the recording sheet discharged from the fixing device 40 carries a toner image on both surfaces thereof in the duplex mode, however, the recording sheet is conveyed to the sheet discharging roller pair. Switching between the sheet discharging roller pair and the refeeding device 50 as the conveyance destination of the recording sheet having passed the fixing device 40 is based on switching of the conveyance destination of the recording sheet performed by a not-illustrated switching plate.

In the refeeding device 50, the recording sheet conveyed from the fixing device 40 is switchback-conveyed on a switchback path 51, and thereby is reversed. Thereafter, the recording sheet is conveyed to a switchback path 52. The recording sheet having passed the switchback path 52 is then conveyed to an intermediate position on the sheet feed path for conveying a recording sheet from the not-illustrated sheet feeding cassette to the secondary transfer nip. Thereby, the recording sheet is refed to the secondary transfer nip in the reversed state.

In the latter portion of the sheet feed path, the recording sheet sequentially passes a resistance measuring roller pair 31 and the registration roller pair 32. The resistance measuring roller pair 31 including rollers 31*a* and 31*b*, a resistance measuring power supply 83, and an ammeter 34 illustrated in FIG. 1 will be later described. The refeeding device 50 conveys the recording sheet to a position on the sheet feed path upstream of the resistance measuring roller pair 31. Therefore, the recording sheet always passes the resistance measuring roller pair 31 and the registration roller pair 32 on the sheet feed path, regardless of whether the recording sheet has just been fed from the sheet feeding cassette or has been refed by the refeeding device 50.

In the present printer, a process linear velocity corresponding to the linear velocity of the photoconductors 2Y, 2M, 2C, and 2K and the intermediate transfer belt 21 is set to approximately 120 mm/sec (millimeters per second).

Figure 2:
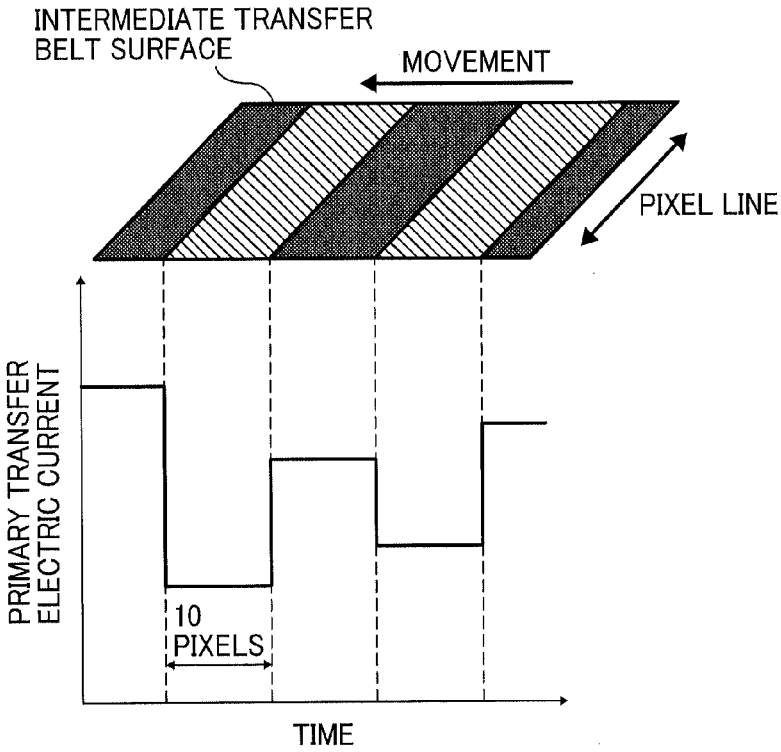
FIG. 2 is a schematic diagram for explaining a 10-line block on an intermediate transfer belt in the printer.

The secondary transfer power supply 82 for applying the secondary transfer bias to the secondary transfer opposite roller 24 outputs a secondary transfer current having the same value as the control target value. The control target value is determined on the basis of the image area ratio in the main scanning direction, i.e., the photoconductor axial direction of the toner image on the intermediate transfer belt 21 at and near the exit of the secondary transfer nip. As illustrated in FIG. 2, the surface of the intermediate transfer belt 21 is theoretically divided into blocks of ten pixels in the sub-scanning direction, i.e., the moving direction of the surface of the intermediate transfer belt 21, with reference to the leading end of each page. Each of the divided blocks (hereinafter referred to as 10-line block) includes ten pixel lines each formed by a collection of pixels aligned in a straight line in the main scanning direction. For each of the pixel lines, the proportion of the number of pixels corresponding to an image area to the total number of pixels is calculated as the image area ratio. Further, the mean value of the image area ratios of the ten pixel lines is calculated as the mean image area ratio of the 10-line block by the later-described control unit 200. The control target value of the secondary transfer current is determined in accordance with the mean image area ratio of one of a plurality of 10-line blocks, which is currently passing the exit of the secondary transfer nip. During the time in which the 10-line block is passing the exit of the secondary transfer nip, the control unit 200 transmits to the secondary transfer power supply 82 a control signal for controlling the value of the current output from the secondary transfer power supply 82 to be equal to the control target value. After the most downstream pixel line of the 10-line block has passed the exit of the secondary transfer nip, the control unit 200 changes the control target value of the secondary transfer current from the secondary transfer power supply 82 in accordance with the mean image area ratio of the next 10-line block, and transmits to the secondary transfer power supply 82 a control signal according to the changed control target value.

The control target value of the secondary transfer current is determined on the basis of the mean image area ratio near the exit of the secondary transfer nip for the following reason. That is, most of the secondary transfer current flowing between the secondary transfer opposite roller 24 and the secondary transfer roller 26 is generated by separating discharge occurring between the intermediate transfer belt 21 and the secondary transfer roller 26 at the exit of the secondary transfer nip at which the intermediate transfer belt 21 and the secondary transfer roller 26 separate from each other. At the exit of the secondary transfer nip, if the image area ratio of the toner image on the inter mediate transfer belt 21 is relatively low when the amount of the current supplied from the secondary transfer power supply 82 is relatively small, most of the secondary transfer current supplied from the secondary transfer power supply 82 is used in the separating discharge occurring between the non-image area on the intermediate transfer belt 21 and the secondary transfer roller 26. With the secondary transfer current hardly flowing into the image area on the intermediate transfer belt 1 21, a transfer failure occurs. If the transfer current is applied in accordance with the mean image area ratio near the exit of the secondary transfer nip, therefore, an appropriate amount of the secondary transfer current is applied the toner image on the intermediate transfer belt 21, and the potential difference between the image area on the intermediate transfer belt 21 and the secondary transfer roller 26 is reduced to be less than a discharge start voltage.

Figure 3:
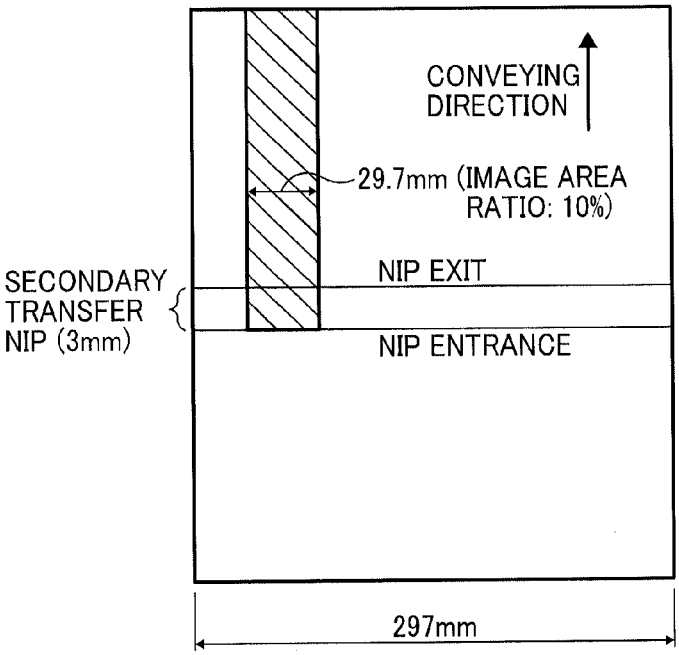
FIG. 3 is a schematic diagram illustrating an example of solid pattern.
Figure 4:
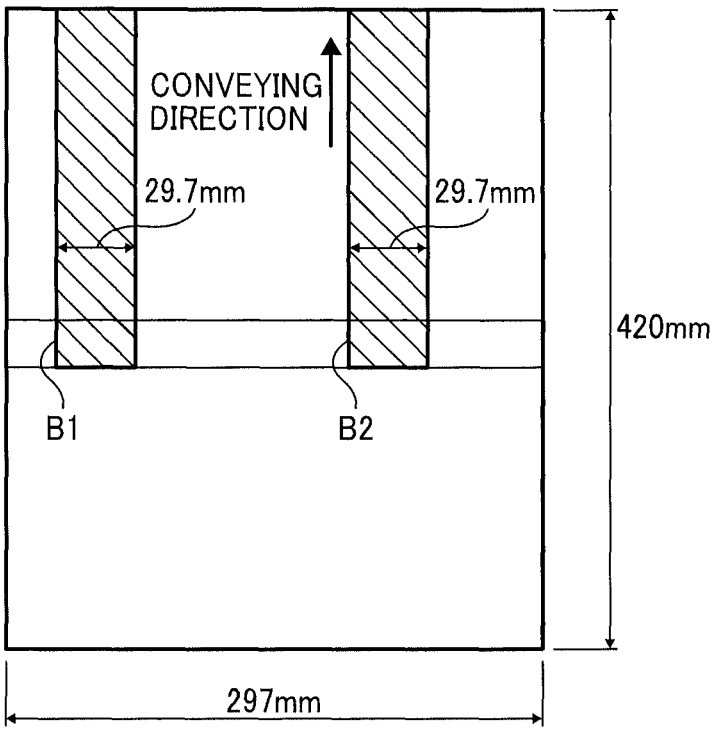
FIG. 4 is a schematic diagram illustrating another example of solid pattern.

Subsequently, an experiment conducted by the present inventor will be described. The present inventor prepared print test equipment similar in configuration to the printer illustrated in FIG. 1, and conducted print tests of a test image by using the print test equipment. The tests employed a recording sheet of A3 size, i.e., approximately 420 mm by approximately 297 mm, toner having a charge amount of approximately −20 μC/g (micro Coulombs per gram) under normal temperature and humidity, and a test image of a band-like solid pattern extending in the sub-scanning direction, i.e., the recording sheet conveying direction, as illustrated in FIG. 3, for example, and formed on the A3-size recording sheet conveyed in the direction of the longer sides of the recording sheet. The tests further employed three image area ratios of approximately 5%, approximately 100%, and approximately 200% as the image area ratio of the solid pattern. The image area ratio is the numerical value representing the proportion of the sum of the sizes of the respective color images to the size of the recording sheet in the main scanning direction perpendicular to the recording sheet conveying direction. For example, the solid pattern illustrated in FIG. 3 includes only one band-like pattern formed by the K toner, and the size of the solid pattern in the main scanning direction is approximately 29.7 mm, which corresponds to approximately 10% of the size of the recording sheet in the main scanning direction, which is approximately 297 mm. Therefore, the illustrated solid pattern is formed with an image area ratio of approximately 10%. Further, for example, the solid pattern illustrated in FIG. 4 includes a band-like pattern B1 formed by the K toner and a band-like pattern B2 formed by the M toner, and each of the band-like patterns B1 and B2 has a size of approximately 29.7 mm in the main scanning direction. In this case, each of the band-like pattern B1 of the K toner and the band-like pattern B2 of the M toner has an image area ratio of approximately 10%. Therefore, the sum of the image area ratios is approximately 20%. The sum of the image area ratios is calculated by the addition of the image area ratios of the respective band-like patterns also in a case where the plurality of band-like patterns are formed in a superimposed manner, as well as the case where the plurality of band-like patterns are formed with a distance from each other, as in the illustrated example. Therefore, the maximum value of the image area ratio is approximately 400%, which corresponds to the image area ratio obtained when respective full-page solid images of the Y, M, C, and K toners are formed.

Figure 5:
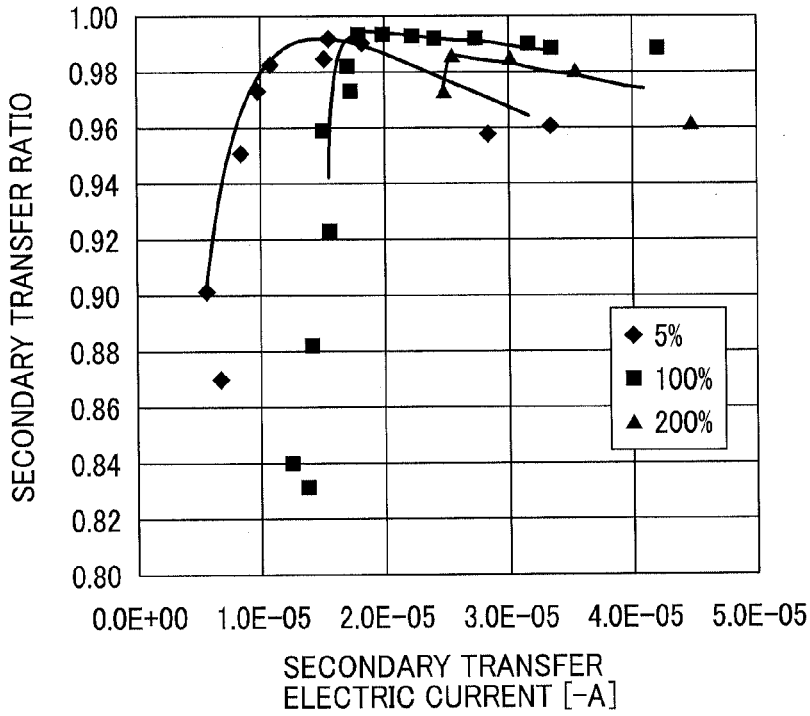
FIG. 5 is graphs illustrating the relationship between a secondary transfer ratio, a secondary transfer current, and an image area ratio obtained by a first print test.
Figure 6:
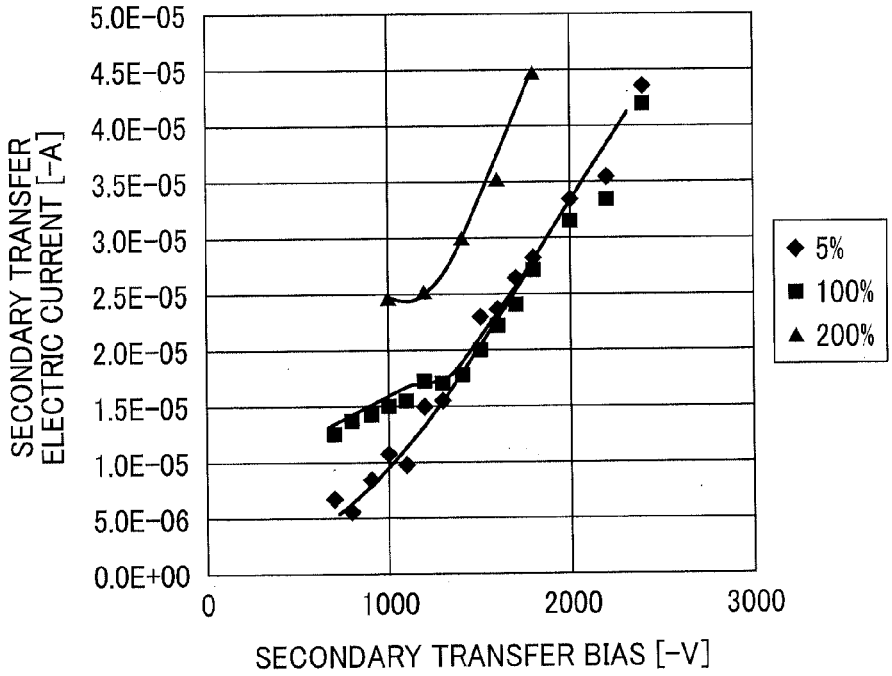
FIG. 6 is graphs illustrating the relationship between the secondary transfer current, a secondary transfer bias, and the image area ratio obtained by the first print test.

A first print test will now be described. In the first print test, the temperature and humidity of a laboratory were adjusted by air conditioning to those of the laboratory environment. Further, a sheet of plain paper My Paper manufactured by NBS Ricoh Company, Ltd. was used as the A3-size recording sheet. The secondary transfer bias output from the secondary transfer power supply 82 was subjected to a constant current control, and solid patterns were printed out under the respective conditions with different control target values of the secondary transfer current. FIG. 5 illustrates the relationship between the secondary transfer ratio, the control target value of the secondary transfer current, and the image area ratio in the first print test. FIG. 6 illustrates the relationship between the control target value of the secondary transfer current, the secondary transfer bias, and the image area ratio in the first print test. The secondary transfer ratio is the numerical value representing the proportion of the amount of the toner transferred to the recording sheet to the amount of the toner on the surface of the intermediate transfer belt 21 before the secondary transfer nip. Under the condition of the image area ratio of approximately 5%, a band-like solid pattern of a single color of the K toner having a size of approximately 14.85 mm in the main scanning direction was output. Under the condition of the image area ratio of approximately 100%, a full-page solid image of the K toner was output. Under the condition of the image area ratio of approximately 200%, a full-page solid image of the M toner and a full-page solid image of the K toner were output in a superimposed manner.

As illustrated in FIG. 5, it is observed that the higher is the image area ratio at the exit of the secondary transfer nip, the larger is the secondary transfer current value providing the maximum secondary transfer ratio (hereinafter referred to as maximum transfer ratio current value). Further, under a condition in which the secondary transfer current value is smaller than the maximum transfer ratio current value, the secondary transfer ratio is increased in accordance with the increase in the secondary transfer current value. Meanwhile, under a condition in which the secondary transfer current value is larger than the maximum transfer ratio current value, the secondary transfer ratio is reduced in accordance with the increase in the secondary transfer current value. That is, to secure the maximum transfer ratio or a transfer ratio close thereto and minimize the formation of an uneven density pattern following the irregularities of the surface of the recording sheet, it is desired to apply the secondary transfer current having an appropriate amount that is neither excessively small nor excessively large. Further, in the laboratory environment, the higher is the image area ratio at the exit of the secondary transfer nip, the larger is the appropriate value of the secondary transfer current.

As illustrated in FIG. 6, the higher is the secondary transfer bias, the larger amount of the secondary transfer current flows, regardless of the image area ratio. The rate of increase in the secondary transfer current sharply rises at a certain bias value. Hereinafter, the bias value corresponding to the sharp rise will be referred to as the point of inflection. The point of inflection prominently appears particularly at the image area ratio of approximately 100% or approximately 200%. As to the secondary transfer current value corresponding to the point of inflection, it is observed that the secondary transfer current value is substantially equal to the maximum transfer ratio current value. For example, in FIG. 6, the secondary transfer current value at the point of inflection under the condition of the image area ratio of approximately 200% is approximately −2.5E-0.5 A. In FIG. 5, the maximum transfer ratio current value is approximately −2.5E-0.5 A. That is, the two current values match. Further, in FIG. 6, the secondary transfer current value at the point of inflection under the condition of the image area ratio of approximately 100% is approximately −1.75E-0.5 A. In FIG. 5, the maximum transfer ratio current value is approximately −1.75E-0.5 A. That is, the two current values match. Further, in FIG. 6, the point of inflection under the condition of the image area ratio of approximately 5% is difficult to identify. However, if the position of start of change in slope is identified as the point of inflection, the secondary transfer current value at the point of inflection is determined from a curve equation as approximately −1.5E-0.5 A, which matches the maximum transfer ratio current value identified in FIG. 5.

The secondary transfer current value at the above-described point of inflection thus matches the maximum transfer ratio current value, regardless of the image area ratio, for the following reason. That is, in the secondarily transfer nip, the secondary transfer ratio of the toner image is basically increased in accordance with the increase in the secondary transfer current flowing into the toner image. If the secondary transfer bias is increased to increase the secondary transfer current to be applied, therefore, the secondary transfer ratio of the toner image is increased. If the secondary transfer bias is increased to the extent that the potential difference between the recesses in the surface of the recording sheet and the intermediate transfer belt 21 exceeds the discharge start voltage, however, discharge occurs between the recesses in the surface of the recording sheet and the intermediate transfer belt 21, and the toner is oppositely charged. As a result, the secondary transfer ratio is rapidly reduced. Further, the discharge causes a rapid increase in the secondary transfer current value. Consequently, the secondary transfer current value at the above-described point of inflection matches the maximum transfer ratio current value.

Figure 7:
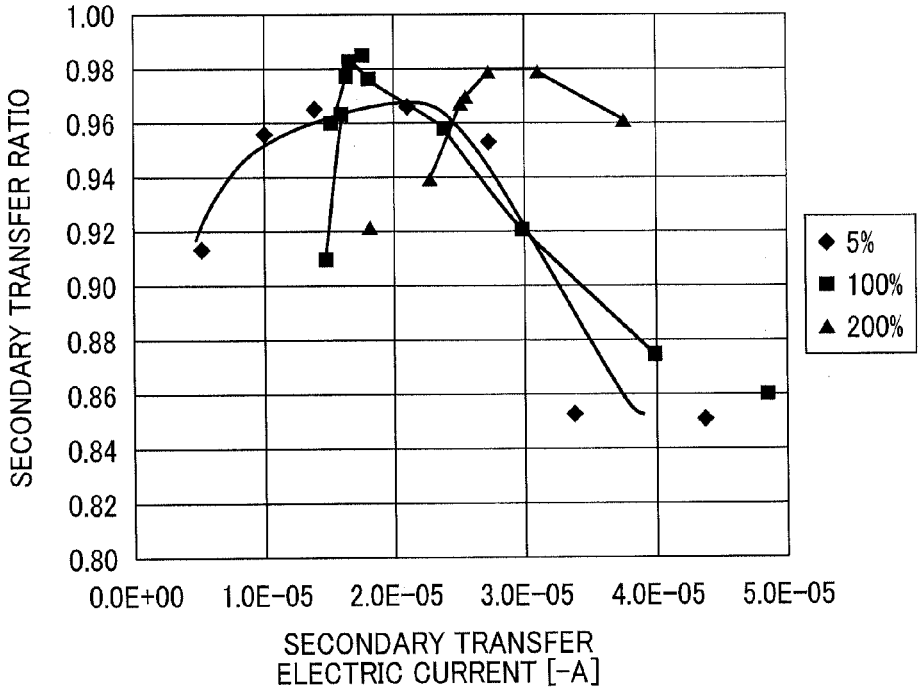
FIG. 7 is graphs illustrating the relationship between the secondary transfer ratio, the secondary transfer current, and the image area ratio obtained by a second print test.
Figure 8:
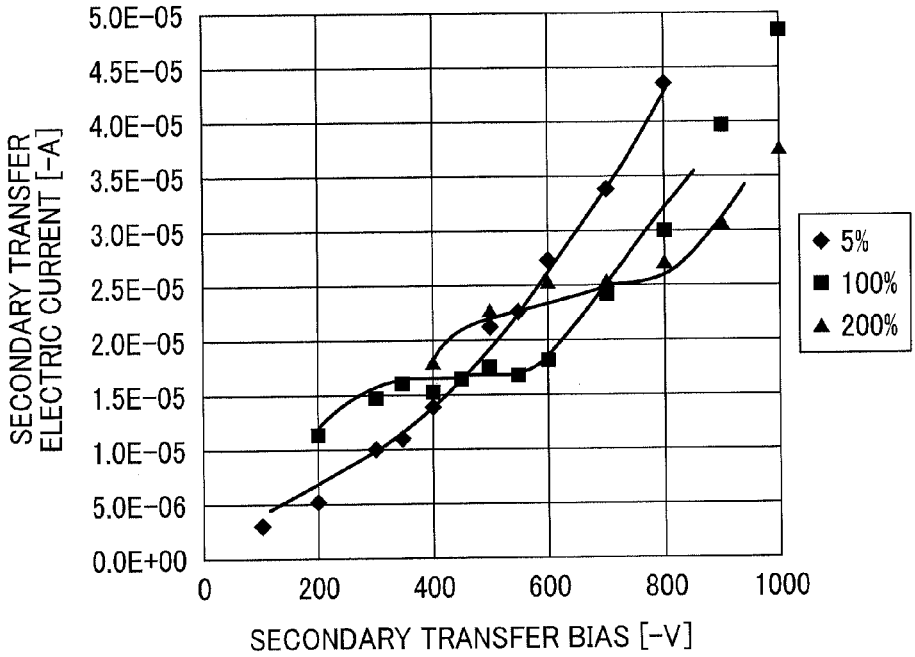
FIG. 8 is graphs illustrating the relationship between the secondary transfer current, the secondary transfer bias, and the image area ratio obtained by the second print test.

Subsequently, a second print test will be described. In the second print test, the temperature and humidity of the laboratory were adjusted by air conditioning to those of the HH environment. Except for this difference, solid patterns were printed out in a similar manner as in the first print test. FIG. 7 illustrates the relationship between the secondary transfer ratio, the control target value of the secondary transfer current, and the image area ratio in the second print test. FIG. 8 illustrates the relationship between the control target value of the secondary transfer current, the secondary transfer bias, and the image area ratio in the second print test.

As illustrated in FIG. 7, in the HH environment, the respective maximum transfer ratio current values at the image area ratios of approximately 5%, approximately 100%, and approximately 200% are approximately −2.3E-0.5 A, approximately −1.7E-0.5 A, and approximately −2.7E-0.5 A. In the laboratory environment, the maximum transfer ratio current value is increased in accordance with the increase in the image area ratio. Meanwhile, in the HH environment, the relationship in magnitude of the maximum transfer ratio current value between the condition of the image area ratio of approximately 5% and the condition of the image area ratio of approximately 100% is reversed. Herein, the secondary transfer current value at the point of inflection will be examined. The secondary transfer current value at the point of inflection in the environment with the image area ratio of approximately 5% is approximately −2.3E-0.5 A, which matches the maximum transfer ratio current value in the same environment. Further, the secondary transfer current value at the point of inflection in the environment with the image area ratio of approximately 100% is approximately −1.7E-0.5 A, which matches the maximum transfer ratio current value in the same environment. That is, the result in the HH environment is similar to the result in the laboratory environment in that the maximum secondary transfer ratio is obtained when the bias value is slightly smaller than the secondary transfer bias value which causes the discharge between the recesses in the surface of the recording sheet and the intermediate transfer belt 21. Thus, the discharge start voltage is increased in accordance with the increase in the image area ratio from approximately 5% to approximately 100% in the laboratory environment, while the discharge start voltage is reduced in accordance with the increase in the image area ratio from approximately 5% to approximately 100% in the HH environment. The above-described contrasting phenomena relate to the difference in electrical resistance of the recording sheet. Specifically, in the laboratory environment, a relatively large amount of moisture is not absorbed in the recording sheet, and thus the recording sheet has a relatively high electrical resistance value. Therefore, current flows on the surface of the recording sheet with relative difficulty. Meanwhile, in the HH environment, the electrical resistance value of the recording sheet is reduced owing to moisture absorption by the recording sheet, and thus current flows on the surface of the recording sheet with relative ease. If the image area ratio is lower than approximately 100%, the intermediate transfer belt 21 includes an area of direct contact with the surface of the recording sheet in the secondary transfer nip (hereinafter referred to as direct contact area). Further, the secondary transfer current relatively easily flows into the direct contact area in the HH environment. Therefore, the larger is the size of the direct contact area, i.e., the lower is the image area ratio, the smaller is the amount of the secondary transfer current flowing into the toner image. To maintain an appropriate value of the secondary transfer current flowing into the toner image, therefore, it is desired to reduce the value of the current output from the secondary transfer power supply 82 in accordance with the increase in the image area ratio, i.e., in accordance with the reduction in size of the direct contact area, contrary to the case of the laboratory environment.

Under the condition of the image area ratio equal to or higher than approximately 100%, the direct contact area is not generated in the secondary transfer nip even in the HH environment. Therefore, the higher is the image area ratio, the more difficult it is for the secondary transfer current to flow into the toner image. Contrary to the case where the image area ratio is lower than approximately 100%, therefore, it is desired to increase the value of the current output from the secondary transfer power supply 82 in accordance with the increase in the image area ratio.

The present inventor further found from an additional experiment that, in an intermediate environment between the HH environment and the laboratory environment, the higher is the image area ratio, the more difficult it is for the secondary transfer current to flow into the toner image under the condition of the image area ratio lower than approximately 100%, similarly as in the laboratory environment, but that the degree of difficulty in flow of the secondary transfer current according to the increase in the image area ratio is not as great as that in the laboratory environment. That is, in the intermediate environment between the HH environment and the laboratory environment, the rate of increase in the control target value of the secondary transfer current according to the increase in the image area ratio is desired to be reduced to be lower than the rate of increase in the laboratory environment.

According to an experiment conducted by the present inventor, if the humidity is equal to or higher than approximately 70%, the value of the current output from the secondary transfer power supply 82 is desired to be reduced in accordance with the increase in the image area ratio under the condition of the image area ratio lower than approximately 100% so as to maintain the maximum transfer ratio current value. Further, if the humidity is higher than approximately 60% and lower than approximately 70%, the value of the current output from the secondary transfer power supply 82 is desired to be increased in accordance with the increase in the image area ratio under the condition of the image area ratio lower than approximately 100% so as to maintain the maximum transfer ratio current value. Further, if the humidity is equal to or lower than approximately 60%, the value of the current output from the secondary transfer power supply 82 is desired to be increased in accordance with the increase in the image area ratio under the condition of the image area ratio lower than approximately 100% so as to maintain the maximum transfer ratio current value. In this case, the rate of increase in the output current value is desired to be increased to be higher than the rate of increase in the case where the humidity is higher than approximately 60% and lower than approximately 70%.

The amount of moisture absorbed by the recording sheet is increased in accordance with the increase in humidity, and the electrical resistance of the recording sheet is accordingly reduced. Therefore, the humidity is an environmental parameter correlated with the electrical resistance of the recording sheet. Further, in general, the humidity is increased in accordance with the increase in temperature. Therefore, the temperature is also an environmental parameter correlated to the electrical resistance of the recording sheet.

Figure 9:
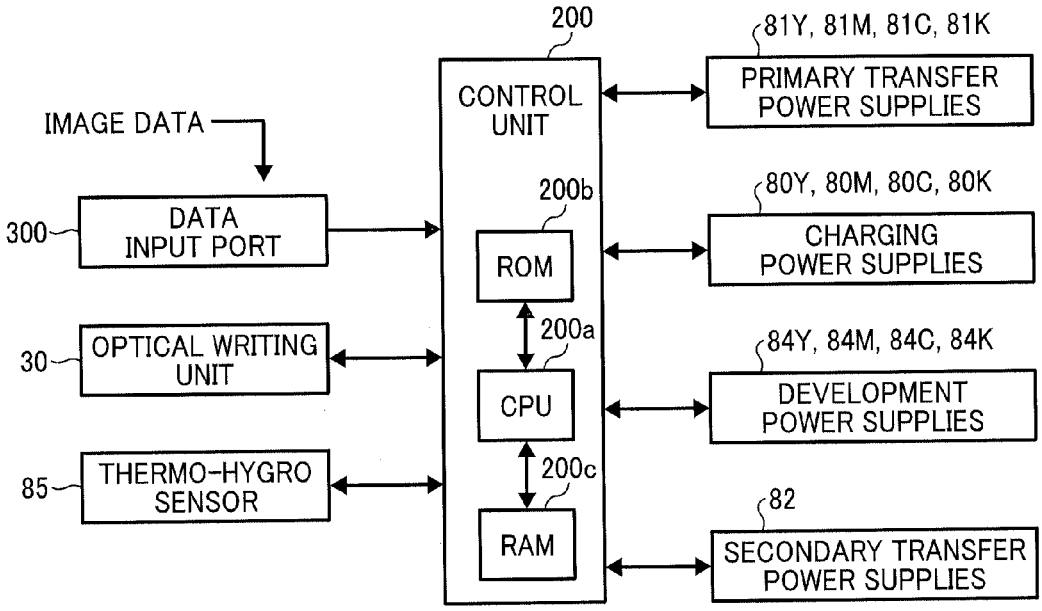
FIG. 9 is a block diagram illustrating a part of an electrical circuit of the printer.

FIG. 9 is a block diagram illustrating a part of an electrical circuit of the printer according to the embodiment. In the present embodiment, the control unit 200 includes, for example, a CPU (Central Processing Unit) 200*a* as an operation device, a RAM (Random Access Memory) 200*c* as a non-volatile memory, and a ROM (Read-Only Memory) 200*b* as a temporary storage device. The control unit 200, which controls the entire printer, controls the driving of the respective devices of the printer on the basis of a control program stored in the RAM 200*c* or the ROM 200*b*. Further, on the basis of image data, i.e., a write signal in the exposure process transmitted from, for example, an external personal computer, the control unit 200 calculates the mean image area ratio of the 10-line block on the intermediate transfer belt 21. Then, on the basis of the result of that calculation, the control unit 200 determines the control target value of the output from the secondary transfer power supply 82, and thereafter outputs the result of determination to the secondary transfer power supply 82. The secondary transfer power supply 82 controls the secondary transfer bias such that the output current value is equal to the control target value transmitted from the control unit 200.

Figure 11:
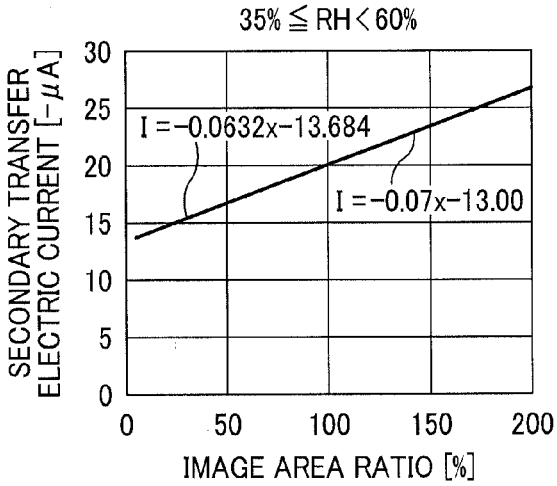
FIG. 11 is a graph illustrating the relationship between a control target value of the secondary transfer current and the image area ratio expressed by a second algorithm.

The control unit 200 is connected to a later-described data input port 300 and a thermo-hygro sensor 85. The control unit 200 determines the control target value on the basis of the mean image area ratio of the 10-line block and the result of detection of the humidity by the thermo-hygro sensor 85. Specifically, as illustrated in the graph of FIG. 11, if the humidity is equal to or higher than approximately 35% and lower than approximately 60%, and if the mean image area ratio x of the 10-line block is lower than approximately 100%, the control unit 200 determines the control target value I (−μA) by using a functional expression: control target value $I=-0.0632x-13.684$. Further, if the humidity is equal to or higher than approximately 35% and lower than approximately 60%, and if the mean image area ratio x of the 10-line block is equal to or higher than approximately 100%, the control unit 200 determines the control target value I (−μA) by using a functional expression: control target value $I=-0.07x-13.00$. A humidity value lower than approximately 60% is a relatively low environmental parameter value. Therefore, the combination of the two functional expressions illustrated in FIG. 11 functions as a second algorithm corresponding to a relatively low environmental parameter value.

Figure 12:
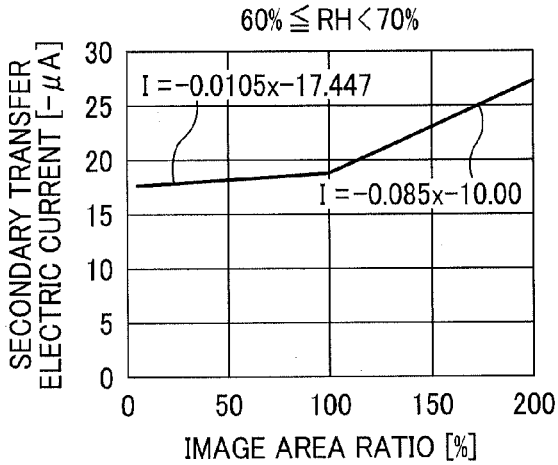
FIG. 12 is a graph illustrating the relationship between the control target value of the secondary transfer current and the image area ratio expressed by a third algorithm.

Further, as illustrated in the graph of FIG. 12, if the humidity is equal to or higher than approximately 60% and lower than approximately 70%, and if the mean image area ratio x of the 10-line block is lower than approximately 100%, the control unit 200 determines the control target value I (−μA) by using a functional expression: control target value $I=-0.0105x-17.447$. Further, if the humidity is equal to or higher than approximately 60% and lower than approximately 70%, and if the mean image area ratio x of the 10-line block is equal to or higher than approximately 100%, the control unit 200 determines the control target value I (−μA) by using a functional expression: control target value $I=-0.085x-10.00$. A humidity value equal to or higher than approximately 60% and lower than approximately 70% is an intermediate environmental parameter value. Therefore, the combination of the two functional expressions illustrated in FIG. 12 functions as a third algorithm corresponding to an intermediate environmental parameter value.

Figure 10:
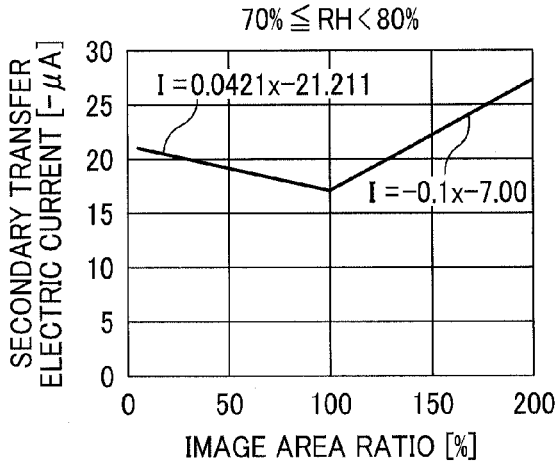
FIG. 10 is a graph illustrating the relationship between the control target value of the secondary transfer current and the image area ratio expressed by a first algorithm.

Further, as illustrated in the graph of FIG. 10, if the humidity is equal to or higher than approximately 70% and lower than approximately 80%, and if the mean image area ratio x of the 10-line block is lower than approximately 100%, the control unit 200 determines the control target value I (−μA) by using a functional expression: control target value I=0.0421x−21.211. Further, if the humidity is equal to or higher than approximately 70% and lower than approximately 80%, and if the mean image area ratio x of the 10-line block is equal to or higher than approximately 100%, the control unit 200 determines the control target value I (−μA) by using a functional expression: control target value I=−0.1x−7.00. A humidity value equal to or higher than approximately 70% and lower than approximately 80% is a relatively high environmental parameter value. Therefore, the combination of the two functional expressions illustrated in FIG. 10 functions as a first algorithm corresponding to a relatively high environmental parameter value.

As described above, the control unit 200 selects, from the plurality of algorithms stored in the ROM 200*b* serving as a storage device, the algorithm according to the result of detection of the humidity by the thermo-hygro sensor 85 serving as an environment detection device. The selected algorithm represents the relationship between the mean image area ratio appropriate for the moisture absorption rate of the recording sheet and the control target value I of the secondary transfer current. Therefore, if the output from the secondary transfer power supply 82 is subjected to a constant current control with the control target value I calculated in accordance with the mean image area ratio of the 10-line block on the basis of the selected algorithm, the secondary transfer current having a substantially constant value is applied to the toner image in the secondary transfer nip, regardless of the moisture absorption rate of the recording sheet and the image area ratio in the secondary transfer nip. Accordingly, the unevenness in image density is minimized with no need to extend the print time for the preliminary sheet feeding for drying the recording sheet or provide a preliminary heating device specifically for preliminary heating of the recording sheet.

Figure 13:
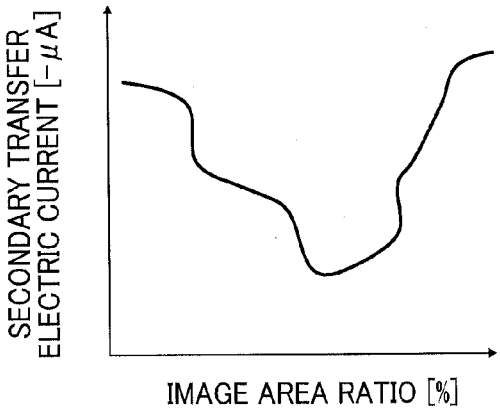
FIG. 13 is a graph illustrating the relationship between the control target value of the secondary transfer current and the image area ratio expressed by the first algorithm.
Figure 14:
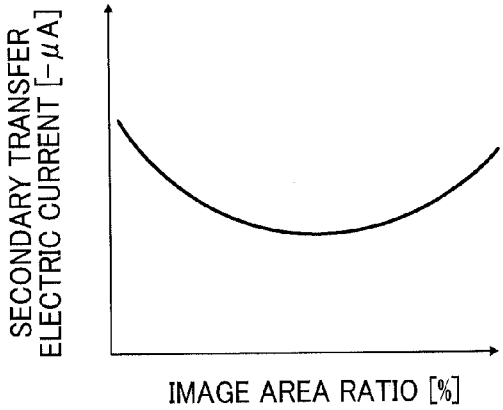
FIG. 14 is a graph illustrating the relationship between the control target value of the secondary transfer current and the image area ratio expressed by the second algorithm.
Figure 15:
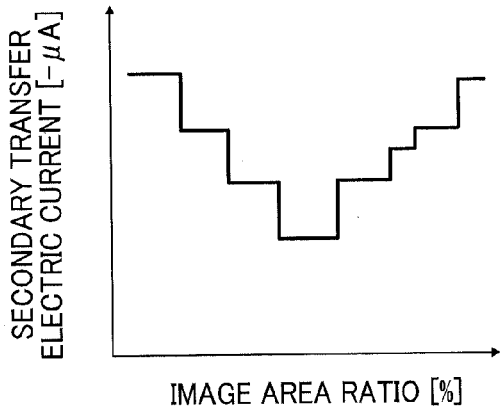
FIG. 15 is a graph illustrating the relationship between the control target value of the secondary transfer current and the image area ratio expressed by the third algorithm.

The algorithm representing the relationship between the control target value I and the image area ratio used in the environment with a humidity equal to or higher than approximately 35% and lower than approximately 60% is not limited to the algorithm expressed by a linear graph as illustrated in FIG. 11, and may be, for example, an algorithm representing the relationship expressed by a curved graph as illustrated in FIG. 14. Further, in the environment with a humidity equal to or higher than approximately 60% and lower than approximately 70%, the algorithm representing the relationship expressed by a linear graph as illustrated in FIG. 12 may be replaced by, for example, an algorithm representing the relationship expressed by a stepped graph as illustrated in FIG. 15. Further, in the environment with a humidity equal to or higher than approximately 70% and lower than approximately 80%, the algorithm representing the relationship expressed by a linear graph as illustrated in FIG. 110 may be replaced by, for example, an algorithm representing the relationship expressed by a curved graph as illustrated in FIG. 13.

Normally, it is desired that the slope of the graph expressed by the algorithm be changed at the image area ratio of approximately 100% as a change point. Depending on the configuration of the printer, however, it may be desired to slightly shift the change point. Desirably, the change point is set in a range of from approximately 90% to approximately 110% to appropriately maintain the maximum transfer ratio current value.

The intermediate transfer belt 21 includes a polyimide belt exhibiting a modulus of elongation of approximately 2.6 GPa, as measured by an elongation test method conforming to JIS (Japanese Industrial Standards) K 7127. Such a belt minimizes an error in superimposing the respective colors, i.e., color registration error attributed to a change in belt velocity. However, the unevenness in density following the irregular pattern on the surface of the recording sheet occurs more easily than in a rubber belt. Conventionally, a rubber belt is selected when priority is given to the suppression of the unevenness in density, and a polyimide belt is selected when priority is given to the suppression of the superimposition error, conceding that it is difficult to minimize both the unevenness in density and the superimposition error. By contrast, the present printer effectively minimizes the unevenness in density even with the use of a polyimide belt, and thus minimizes both the unevenness in density and the superimposition error.

Further, in the present printer, the control unit 200 is configured to determine not only the control target value of the secondary transfer current but also the control target value of the primary transfer current in accordance with the image area ratio. Specifically, the control unit 200 calculates the mean image area ratio of the 10-line block on each of the photoconductors 2Y, 2M, 2C, and 2K for each of the exits of the primary transfer nips for the Y, M, C, and K colors, and determines the control target value of the primary transfer current for each of the Y, M, C, and K colors in accordance with the result of calculation. The control unit 200 then outputs the result of determination to the primary transfer power supplies 81Y, 81M, 81C, and 81K. Thereby, a favorable primary transfer ratio is maintained in the primary transfer nips for the Y, M, C, and K colors, regardless of the image area ratio.

In a print job in the duplex mode, when a toner image is to be secondary-transferred to the first surface of the recording sheet, the recording sheet has a moisture absorption amount according to the humidity. Therefore, the control target value I of the secondary transfer current should be determined in the above-described manner. When a toner image is to be secondary-transferred to the second surface of the recording sheet, however, the recording sheet has already passed the fixing device 40, and thus the moisture absorption amount of the recording sheet has been substantially reduced. The moisture absorption amount of the recording sheet having passed the fixing device 40 has been reduced to a sufficiently small amount hardly affecting the amount of the secondary transfer current flowing into the toner image.

When a toner image is secondary-transferred to the second surface of the recording sheet refed by the refeeding device 50, therefore, the control unit 200 performs a process of calculating the control target value I by using the second algorithm illustrated in FIG. 11, regardless of the result of detection of the humidity by the thermo-hygro sensor 85.

In the above-described example, the second algorithm, the third algorithm, and the first algorithm corresponding to different humidity values are used as the plurality of algorithms. The plurality of algorithms may also include the following algorithms. That is, the relationship between the image area ratio and the maximum transfer ratio current value may be examined for each of different temperature ranges on the basis of a previously conducted experiment, and a plurality of algorithms individually representing the relationships may be employed. In this case, the control unit 200 may be configured to perform a process of selecting, from the plurality of algorithms stored in the ROM 200*b*, the algorithm corresponding to the result of detection of the temperature by the thermo-hygro sensor 85 and using the selected algorithm to calculate the control target value.

Further, the following algorithms may be employed. That is, the relationship between the image area ratio and the maximum transfer ratio current value may be examined for each of different electrical resistance ranges of the recording sheet on the basis of a previously conducted experiment, and a plurality of algorithms individually representing the relationships may be employed. In this case, the electrical resistance of the recording sheet may be measured when the recording sheet is conveyed through the resistance measuring roller pair 31 illustrated in FIG. 1. Specifically, a measurement current output from the resistance measuring power supply 83 may be applied from the roller 31*a* to the roller 31*b* of the resistance measuring roller pair 31, and the value of the measurement current may be measured by the ammeter 34. Further, the electrical resistance of the recording sheet may be calculated on the basis of the output voltage value and the current value measured when the recording sheet passes the nip between the rollers 31*a* and 31*b*. The control unit 200 may be configured to perform a process of selecting the algorithm corresponding to the thus calculated electrical resistance and using the selected algorithm to calculate the control target value.

Subsequently, a description will be given of a printer according to another embodiment.

In general, the type of recording sheets are used in a printer are varied depending on the application, that is, in accordance with the intent of a user. In some cases, a recording medium made of a material different from paper, such an OHP (Over Head Projector) sheet, is used. A feature common to different recording media is that each of the recording media is a recording sheet formed into a sheet shape. The moisture absorbency of a recording sheet varies depending on, for example, the material forming the recording sheet or the surface treatment performed on the recording sheet. Therefore, the relationship between the electrical resistance of the recording sheet and the humidity varies depending on the type of the recording sheet. To highly accurately maintain the value of the secondary transfer current flowing through the secondary transfer nip to be close to the maximum transfer ratio current value, therefore, it is desired to construct the algorithms by examining the relationship between the image area ratio and the maximum transfer ratio current value for each of a plurality of humidity ranges for each of recording sheet types.

The printer according to the present embodiment, therefore, stores a plurality of algorithms, i.e., a second algorithm, a third algorithm, and a first algorithm corresponding to different humidity ranges, which are constructed in the above-described manner for each of a plural types of recording sheets. For example, paper Type 6000-70W manufactured by NBS Ricoh Company, Ltd., which is an example of the plural types of recording sheets, tends to be lower in electrical resistance than the foregoing paper My Paper. Therefore, the transfer current flows more easily in the paper Type 6000-70W than in the paper My Paper in the same humidity environment. In view of this, the following two relational expressions are stored in the ROM 200*b* as the first algorithm for the paper Type 6000-70W. That is, an expression: control target value I (−μA)=0.0632x−23.3158 is stored as a relational expression employed when the image area ratio x is equal to or higher than approximately 0% and lower than approximately 100%. Further, an expression: control target value I (−μA)=−0.1x−7.00 is stored as a relational expression employed when the image area ratio x is equal to or higher than approximately 100%.

As for the OHP sheet, which is insulating and is not moisture absorbent, the same algorithm is employed regardless of the result of detection of the humidity.

As described above with reference to FIG. 9, the image data transmitted from, for example, an external personal computer, is input to the control unit 200 via the data input port 300. The image data includes, as well as image per se, the information of the size and type of the recording sheet to be output. The information is input by a user with the use of printer driver utility software installed in, for example, a personal computer. In the printer according to the present embodiment, the data input port 300, which acquires the image data including the information of the type of the recording sheet, functions as a type information acquisition device which acquires the type information of the recording sheet.

Upon receipt of the transmitted image data, the control unit 200 extracts only the algorithms corresponding to the type information of the recording sheet included in the image data. The control unit 200 further identifies, from the extracted algorithms, the algorithm corresponding to the humidity detected by the thermo-hygro sensor 85, and uses the identified algorithm to calculate the control target value I.

As described above, in the printer according to the embodiment, among the plurality of algorithms stored in the ROM 200*b*, an algorithm which reduces the control target value I of the secondary transfer current in accordance with the increase in the image area ratio, if the image area ratio is in a range of from approximately 0% to approximately 99% corresponding to a predetermined threshold value, and which increases the control target value I of the secondary transfer current in accordance with the increase in the image area ratio, if the image area ratio is higher than approximately 99%, is employed as the first algorithm corresponding to a relatively high humidity, as illustrated in FIG. 10. In this configuration, if the electrical resistance of the recording sheet is substantially reduced by moisture absorption, the secondary transfer bias is increased in accordance with the increase in size of the direct contact area in which the intermediate transfer belt 21 and the recording sheet come into direct contact with each other in the secondary transfer nip, to thereby apply an effective secondary transfer current to the toner image and minimize the unevenness in image density.

Further, in the printer according to the embodiment, among the plurality of algorithms stored in the ROM 200*b*, an algorithm which increases the control target value I in accordance with the increase in the image area ratio, regardless of whether or not the image area ratio is lower than approximately 100%, is employed as the second algorithm corresponding to a relatively high resistance value, as illustrated in FIG. 11. In this configuration, the secondary transfer current having a current value close to the maximum transfer ratio current value is applied to the toner image, regardless of the image area ratio, under a circumstance in which the recording sheet has a sufficiently high electrical resistance not substantially affecting the secondary transfer current flowing to the toner image in the secondary transfer nip.

Further, in the printer according to the embodiment, among the plurality of algorithms stored in the ROM 200*b*, an algorithm which increases the control target value I in accordance with the increase in the image area ratio at a rate of increase lower than the rate of increase of the second algorithm, if the image area ratio is in a range of from approximately 0% to approximately 99%, is employed as the third algorithm corresponding to an intermediate humidity, as illustrated in FIG. 12. In this configuration, the secondary transfer current having a current value close to the maximum transfer ratio current value is applied to the toner image, regardless of the image area ratio, under a circumstance in which the electrical resistance of the recording sheet is reduced by a certain degree by an intermediate level of moisture absorption.

Further, the printer according to the embodiment includes the fixing device 40 and the refeeding device 50. The fixing device 40 heats the recording sheet conveyed from the secondary transfer nip, to thereby fix the toner image on the recording sheet. The refeeding device 50 reverses the recording sheet conveyed from the fixing device 40, and refeeds the reversed recording sheet to the secondary transfer nip to transfer a toner image to the second surface of the recording sheet as well as to the first surface thereof. Further, the control unit 200 serving as a transfer current control device is configured to perform, when a toner image is to be transferred to the recording sheet refed by the refeeding device 50, a process of calculating the control target value I by using the second algorithm, regardless of the result of detection of the humidity. This configuration prevents the unevenness in image density attributed to the use of the first algorithm, which corresponds to a substantially low electrical resistance value, despite a substantially high electrical resistance value of the recording sheet even in a relatively highly humid environment owing to the passage of the recording sheet through the fixing device 40.

Further, the printer according to the embodiment includes the data input port 300 serving as a type information acquisition device which acquires the type information of the recording sheet conveyed to the secondary transfer nip. Further, in the printer according to the embodiment, the ROM 200*b* stores a plurality of algorithms corresponding to different humidity ranges for each of a plurality of recording sheet types. Further, the control unit 200 is configured to perform a process of selecting, from the plurality of algorithms, the algorithm according to the combination of the result of acquisition of the sheet type information and the result of detection of the humidity and using the selected algorithm to calculate the control target value I. This configuration minimizes the unevenness in image density, regardless of the type of the recording sheet.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming apparatus, comprising:

an image carrying member to carry a toner image;

an intermediate transfer member to carry, on a moving surface thereof, the toner image transferred from the image carrying member;

a nip forming member to come into contact with the intermediate transfer member to form a transfer nip, in which a surface of the nip forming member moves in the same direction as the moving direction of the intermediate transfer member, and the toner image on the intermediate transfer member is transferred onto a surface of a recording sheet conveyed to the transfer nip;

a transfer current output device to output a transfer current to be applied between the intermediate transfer member and the nip forming member;

a detection device comprising a resistance detection device configured to detect the electrical resistance of the recording sheet and an environment detection device configured to detect an environmental parameter correlated with the electrical resistance detected by the resistance detection device;

a storage device to store, as an algorithm for calculating a target value of the transfer current according to a toner image area ratio in the transfer nip, a plurality of algorithms corresponding to different values for one of the electrical resistance and the environmental parameter; and a transfer current control device to perform a process of selecting, from the plurality of algorithms, an algorithm according to the result of detection the detection device, and using the selected algorithm to calculate the target value, the transfer current control device controlling an output value from the transfer current output device to cause a transfer current value to match the target value calculated with the selected algorithm based on the toner image area ratio in the transfer nip.

2. The image forming apparatus according to claim 1, wherein the plurality of algorithms stored in the storage device include, as a first algorithm corresponding to one of a relatively low electrical resistance value and a relatively high environmental parameter value, an algorithm which reduces the target value in accordance with an increase in the toner image area ratio, if the toner image area ratio is in a range of from approximately 0% to a predetermined threshold value, and which increases the target value in accordance with the increase in the toner image area ratio, if the toner image area ratio exceeds the threshold value.

3. The image forming apparatus according to claim 2, wherein the threshold value is in a range of from approximately 90% to approximately 110%.

4. The image forming apparatus according to claim 2, wherein the plurality of algorithms stored in the storage device include, as a second algorithm corresponding to one of a relatively high electrical resistance value and a relatively low environmental parameter value, an algorithm which increases the target value in accordance with the increase in the toner image area ratio, regardless of the relationship between the toner image area ratio and the threshold value.

5. The image forming apparatus according to claim 4, wherein the threshold value is in a range of from approximately 90% to approximately 110%.

6. The image forming apparatus according to claim 4, wherein the plurality of algorithms stored in the storage device include, as a third algorithm corresponding to one of an intermediate electrical resistance value and an intermediate environmental parameter value, an algorithm which increases the target value in accordance with the increase in the toner image area ratio at a rate of increase lower than the rate of increase of the second algorithm, if the toner image area ratio is in a range of from approximately 0% to the threshold value.

7. The image forming apparatus according to claim 6, wherein the threshold value is in a range of from approximately 90% to approximately 110%.

8. The image forming apparatus according to claim 6, further comprising:

a fixing device to heat the recording sheet conveyed from the transfer nip, to thereby fix the toner image on the recording sheet; and a refeeding device to reverse the recording sheet conveyed from the fixing device and refeed the reversed recording sheet to the transfer nip to transfer the toner image to a second surface of the recording sheet as well as to a first surface thereof, wherein the transfer current control device performs, when the toner image is to be transferred to the recording sheet refed by the refeeding device, a process of calculating the target value by using the second algorithm, regardless of the result of detection by the detection device.

9. The image forming apparatus according to claim 1, further comprising:

a recording sheet type information acquisition device to acquire type information of the recording sheet conveyed to the transfer nip, wherein the storage device stores, for each of a plurality of recording sheet types, a plurality of algorithms corresponding to different values for the environmental parameter, and wherein the transfer current control device performs a process of selecting, from the plurality of algorithms, an algorithm according to a combination of the type of recording sheet acquired by the type information acquisition device and the result of detection by the environment detection device, and using the selected algorithm for calculating the target value.

10. The image forming apparatus according to claim 1, wherein the environmental parameter is at least one of humidity and temperature.

* * * * *